US010101127B2

(12) United States Patent
Visinski et al.

(10) Patent No.: US 10,101,127 B2
(45) **Date of Patent: *Oct. 16, 2018**

(54) ACCESSORY ATTACHMENT DEVICE FOR A FIREARM

(71) Applicants: Andrew Visinski, Seymour, CT (US); Matthew A. Sharron, Seymour, CT (US)

(72) Inventors: Andrew Visinski, Seymour, CT (US); Matthew A. Sharron, Seymour, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/347,819

(22) Filed: Nov. 10, 2016

(65) Prior Publication Data

US 2017/0067720 A1 Mar. 9, 2017

Related U.S. Application Data

(63) Continuation-in-part of application No. 14/733,261, filed on Jun. 8, 2015, now Pat. No. 9,523,558.

(51) Int. Cl.
*F41C 23/16* (2006.01)
*F41G 11/00* (2006.01)

(52) U.S. Cl.
CPC ..... *F41G 11/003* (2013.01)

(58) Field of Classification Search
CPC ..... F41C 23/16; F41C 23/02; F41G 11/003; F41A 23/08; F41A 23/10
USPC ..... 42/90, 124–128, 72, 94, 71.01
See application file for complete search history.

(56) References Cited

U.S. PATENT DOCUMENTS

| | | | | |
|---|---|---|---|---|
| 7,111,424 | B1 * | 9/2006 | Moody | F41A 23/08 248/171 |
| 7,797,875 | B1 * | 9/2010 | Carrier | F41G 11/003 211/85.7 |
| 7,891,126 | B2 * | 2/2011 | Moody | F41C 23/16 248/171 |
| 8,156,678 | B2 * | 4/2012 | Hoel | F41G 11/003 42/124 |
| 8,393,104 | B1 * | 3/2013 | Moody | F41C 23/14 42/71.01 |
| 8,505,229 | B2 * | 8/2013 | Savoy | F41G 11/003 42/128 |
| 8,567,301 | B1 * | 10/2013 | Sharron | F41A 35/06 89/1.4 |
| 9,239,209 | B2 * | 1/2016 | Mayberry | F41G 11/005 |
| 9,239,210 | B2 * | 1/2016 | Mayberry | F41C 23/16 |
| 9,523,558 | B2 * | 12/2016 | Visinski | F41C 27/00 |
| 9,857,142 | B2 * | 1/2018 | Sharron | F41C 27/00 |
| 2005/0188597 | A1 * | 9/2005 | Keng | F41A 23/08 42/94 |
| 2006/0277809 | A1 * | 12/2006 | Moody | F41A 23/08 42/72 |
| 2008/0034638 | A1 * | 2/2008 | Spuhr | F41G 11/006 42/127 |

(Continued)

*Primary Examiner* — Michael D David
(74) *Attorney, Agent, or Firm* — Buckingham, Doolittle & Burroughs, LLC

(57) ABSTRACT

An improved device for enabling a user to quickly and securely attach and detach an accessory (e.g., a scope, light, bayonet, etc.) to the Picatinny or tactical rail of a firearm. In a preferred embodiment of the present invention, the device comprises a lower portion, an upper portion and a locking mechanism. The device is relatively inexpensive to manufacture and safe and easy to use.

15 Claims, 9 Drawing Sheets

(56) References Cited

U.S. PATENT DOCUMENTS

| | | | | |
|---|---|---|---|---|
| 2010/0005697 | A1* | 1/2010 | Fluhr | F41G 1/02 42/111 |
| 2010/0107467 | A1* | 5/2010 | Samson | F41G 11/003 42/127 |
| 2011/0047850 | A1* | 3/2011 | Rievley | F41C 23/16 42/72 |
| 2011/0099873 | A1* | 5/2011 | Bentley | F41C 23/16 42/71.01 |
| 2014/0115940 | A1* | 5/2014 | Bonelli | F16M 11/14 42/94 |
| 2014/0237883 | A1* | 8/2014 | Hosz | F41C 27/00 42/105 |
| 2014/0338245 | A1* | 11/2014 | Lanasa | F41C 23/16 42/72 |
| 2015/0020429 | A1* | 1/2015 | Savoy | F41G 11/003 42/111 |
| 2015/0159977 | A1* | 6/2015 | Tseng | F41C 23/04 42/75.03 |
| 2016/0003460 | A1* | 1/2016 | Li | F21V 21/08 362/191 |
| 2016/0097611 | A1* | 4/2016 | Sharron | F41C 27/00 42/90 |
| 2016/0102946 | A1* | 4/2016 | Sharron | F41G 11/003 42/90 |
| 2016/0102947 | A1* | 4/2016 | Visinski | F41G 11/003 42/90 |
| 2017/0045334 | A1* | 2/2017 | Yim | F41G 11/003 |
| 2017/0067720 | A1* | 3/2017 | Visinski | F41G 11/003 |
| 2018/0051959 | A9* | 2/2018 | Sharron | F41C 27/00 |

* cited by examiner

ACCESSORY ATTACHMENT DEVICE FOR A FIREARM

CROSS-REFERENCE

This application claims priority from U.S. Non-Provisional patent application Ser. No. 14/733,261 filed on Jun. 8, 2015, which claims priority from U.S. Non-Provisional patent application Ser. No. 14/662,342 filed on Mar. 19, 2015 and from Provisional Patent Application Ser. Nos. 62/062,441 filed on Oct. 10, 2014 and 62/067,612 filed on Oct. 23, 2014, all of which are herein incorporated by reference.

FIELD OF THE INVENTION

This invention relates to a quick release attachment for mounting accessories (e.g., a scope, light, bayonet, etc.) on the Picatinny or tactical rail of a firearm.

BACKGROUND

Many individuals and firearm enthusiasts desire to mount one or more interchangeable accessories, such as a scope, light, bayonet and the like, onto their firearms. Historically, this has been accomplished by fixedly mounting the accessory to the Picatinny or tactical rail of the firearm, which is essentially a bracket that can be attached to a firearm and which provides a standard mounting platform for a desired attachment. However, heretofore, the process of mounting such accessories to the Picatinny rail has required the use of external tools, and has been both awkward and time-consuming. Moreover, the inability to timely attach a desired accessory to a firearm, or switch accessories, can be dangerous for the user. For example, in combat, a soldier's inability to quickly attach a bayonet to his firearm could result in death or serious injury to the soldier.

Consequently, there is a long felt need in the art for a device that enables a user to quickly and securely attach/detach an accessory (e.g., a scope, light, bayonet, etc.) to the Picatinny or tactical rail of a firearm without the use of external tools. There is also a long felt need for a device that is capable of being locked/unlocked with a single hand, thereby allowing the user to retain possession of the firearm with his remaining hand. Finally, there is a long felt need for a device that accomplishes all of the forgoing objectives, and that is relatively inexpensive to manufacture and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed herein, in one aspect thereof, is a device for enabling a user to quickly and securely attach/detach an accessory (e.g., a scope, light, bayonet, etc.) to the Picatinny or tactical rail of a firearm. In a preferred embodiment of the present invention, the device comprises a lower portion, an upper portion, and a locking mechanism, wherein said locking mechanism further comprises a handle portion, a latch with a spring attached thereto, and at least one lock that is repositionable by the movement of said latch.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
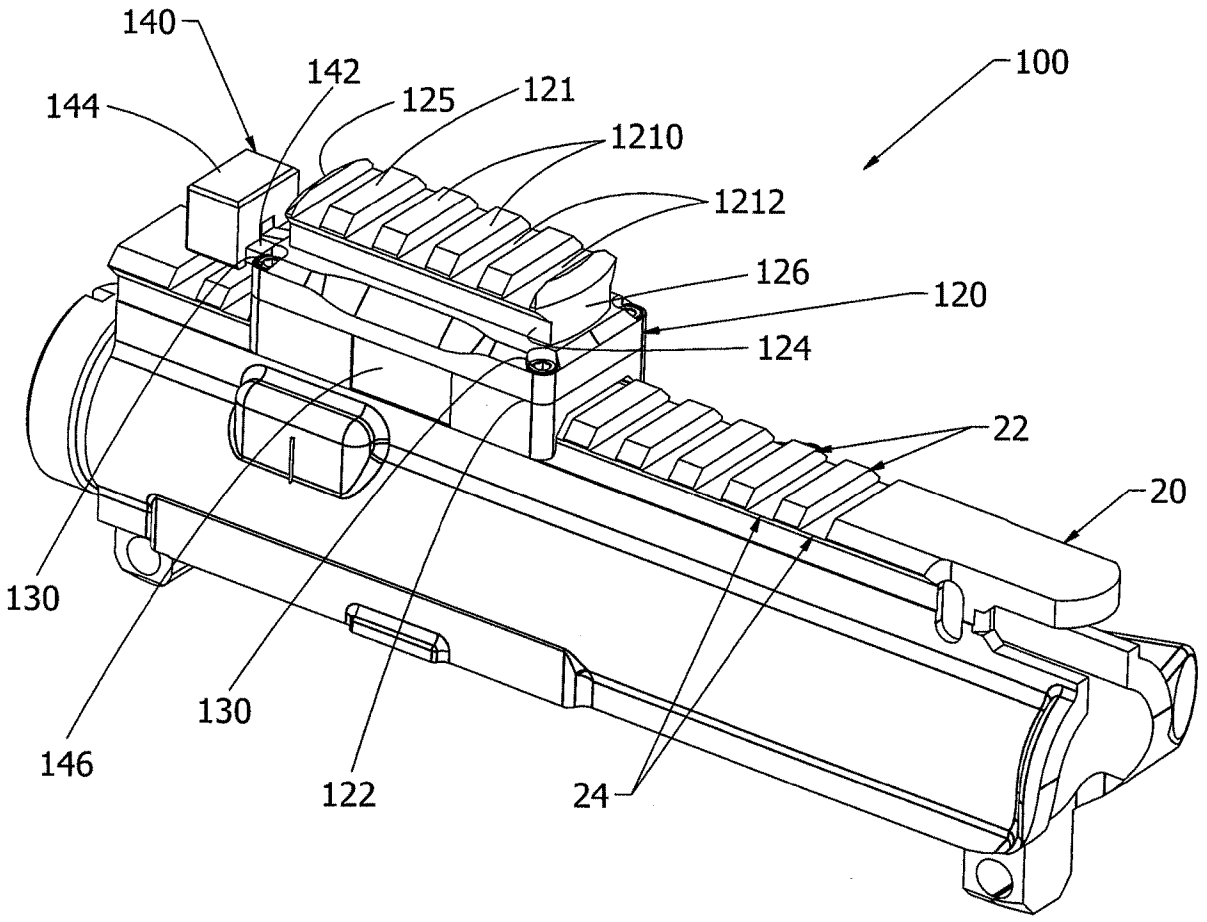
FIG. 1 is a perspective view of the device of the present invention securely attached to a Picatinny rail of a firearm.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Figure 2:
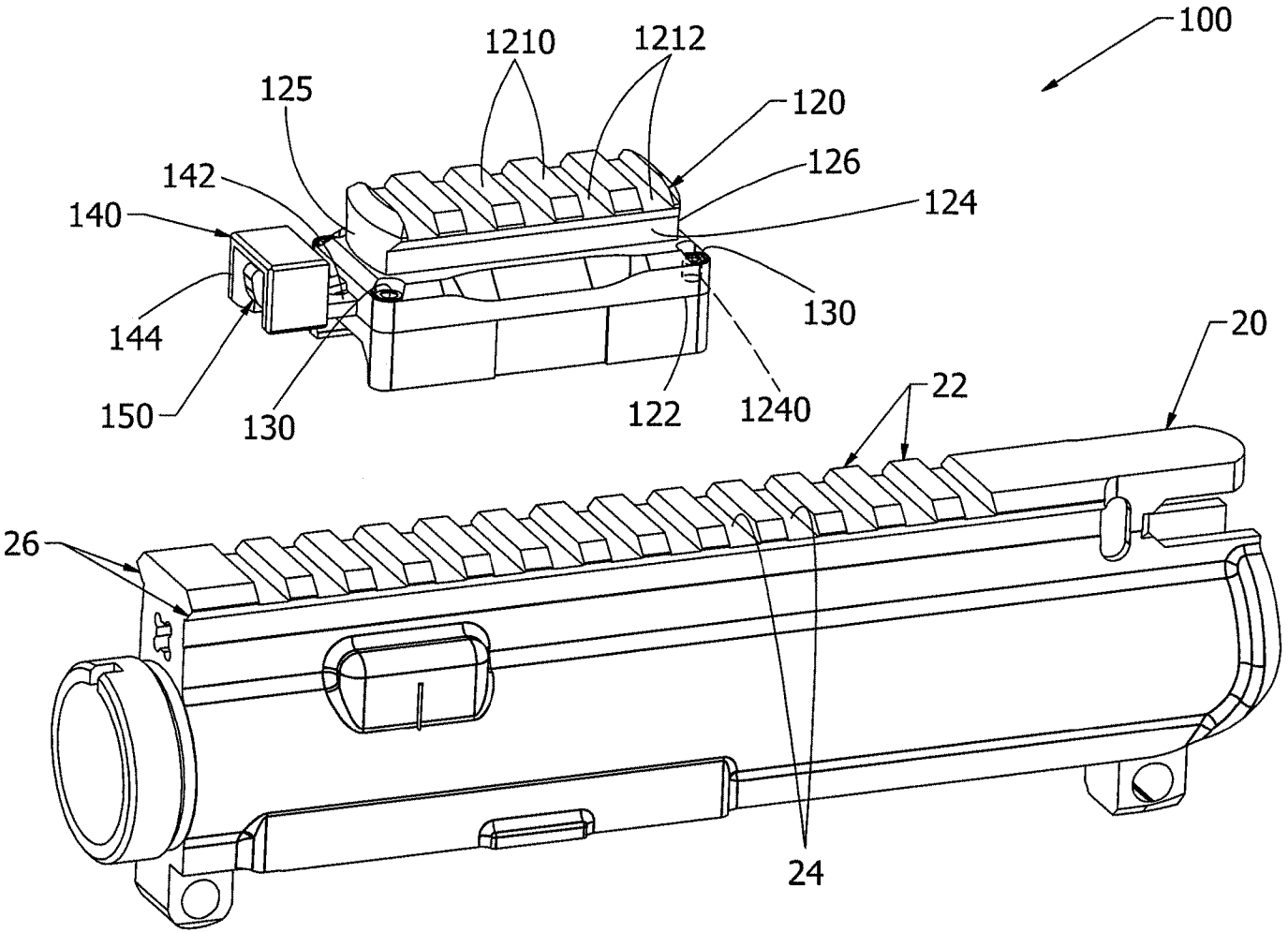
FIG. 2 is a perspective view of the device of FIG. 1 detached from a Picatinny rail of a firearm.
Figure 3A:
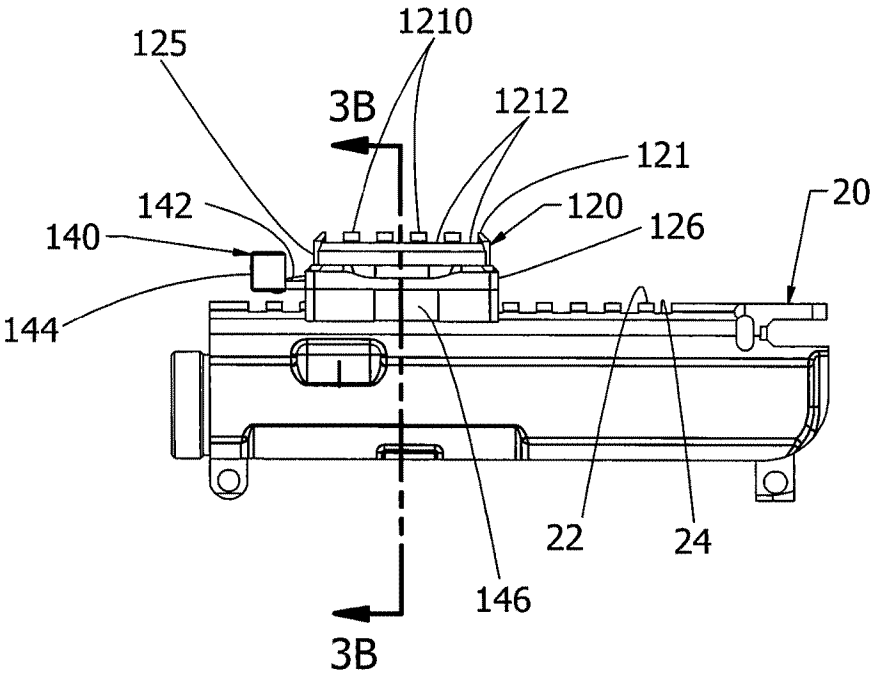
FIG. 3A is a side elevational view of the device of FIG. 1 securely attached to a Picatinny rail of a firearm.
Figure 3B:
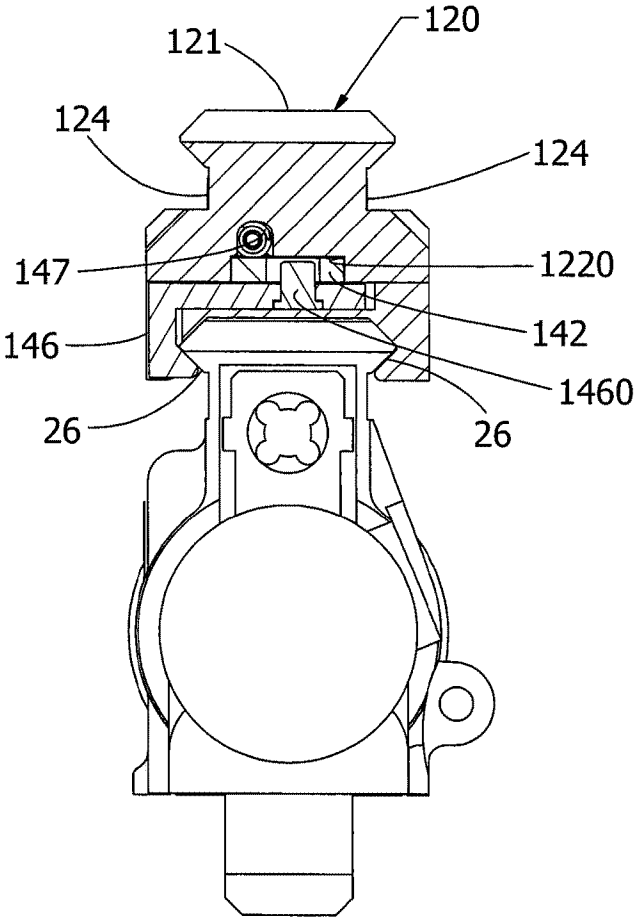
FIG. 3B is a cross-sectional view of the device depicted in FIG. 3A at cut line 3B-3B.

Referring initially to the drawings, FIG. 1 depicts a perspective view of the side slide lock and quick release device 100 of the present invention securely attached to a Picatinny rail 20 of a firearm (not shown), and FIG. 2 depicts a perspective view of the device 100 of the present invention detached from Picatinny rail 20. By way of background, Picatinny rail 20 is an elongated bracket that may be attached to a firearm to provide a standard mounting platform for accessories and attachments such as a scope, light, bayonet and the like. Rail 20 is typically comprised of a plurality of raised, spaced apart lugs or ridges 22 along its top or upper surface, with channels 24 located between and formed by said ridges 22, and a rail flange 26 extending along each side of rail 20.

The side slide lock and quick release device 100 of the present invention is preferably comprised of a lower portion 110, an upper portion 120 removably attached to said lower portion 110 through the use of fasteners 130, and a locking mechanism 140 for detachably securing device 100 to rail 20 without the need for external tools. As best illustrated in FIGS. 5-9, lower portion 110 is an elongated member having a top surface 111, a bottom surface 112, opposing side surfaces 113, a rear 115, a front 116, a rear fence 117 and a forward fence 118, wherein said rear fence 117 and said forward fence 118 extend downwardly from said bottom surface 112 for mating engagement with rail 20, as described more fully below.

As shown in the FIGS., lower portion 110 further comprises one or more continuous openings 1112 that extend between top surface 111 and bottom surface 112, and from a first side surface 113 in the direction of a second side surface 113, for receipt of a portion of locking mechanism 140, as described more fully below. Top surface 111 may also comprise a plurality of spaced apart openings 1114 for receipt of fasteners 130 to fixedly attach lower portion 110 to upper portion 120, as well as openings 1115 for receipt of aligning pins 135 which are useful for properly aligning lower portion 110 to upper portion 120.

Figure 4B:
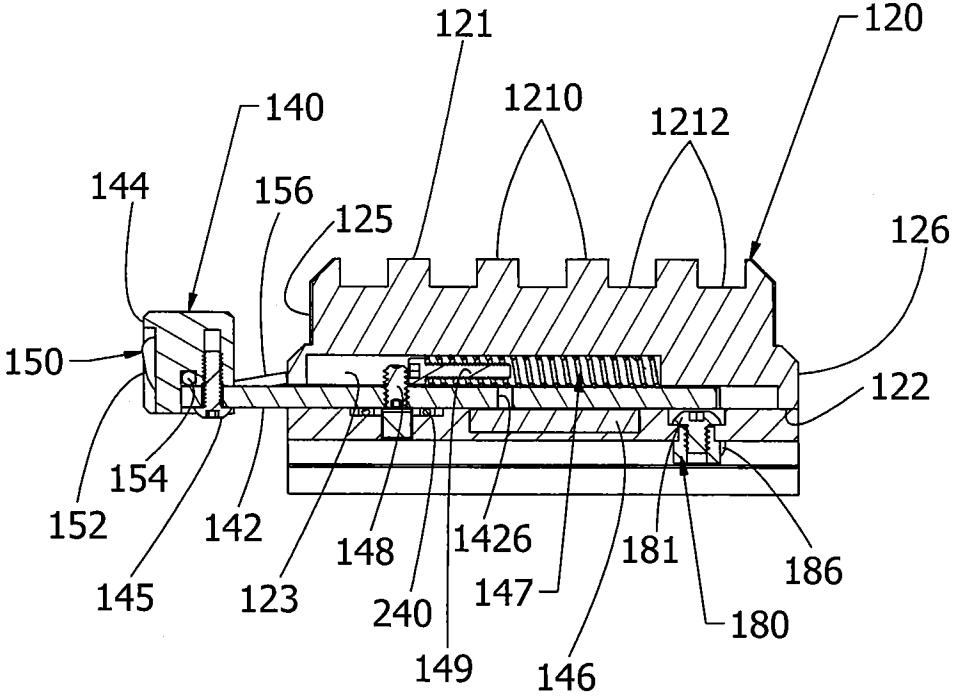
FIG. 4B is a cross-sectional view of the device depicted in FIG. 4A at cut line 4B-4B.
Figure 4A:
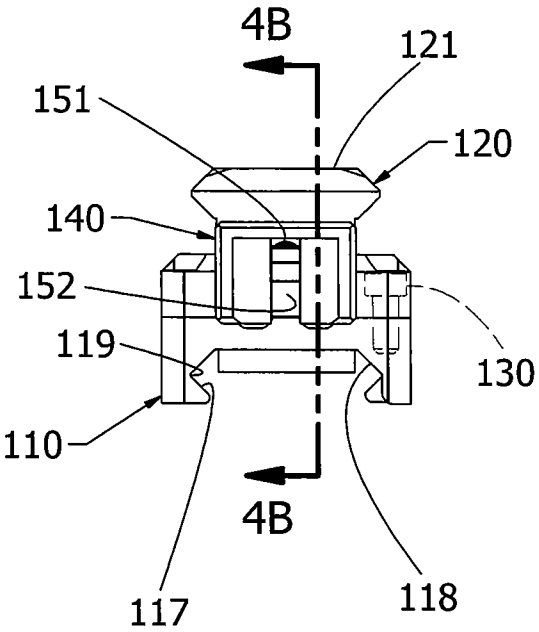
FIG. 4A is a front elevational view of the device of FIG. 1.
Figure 7:
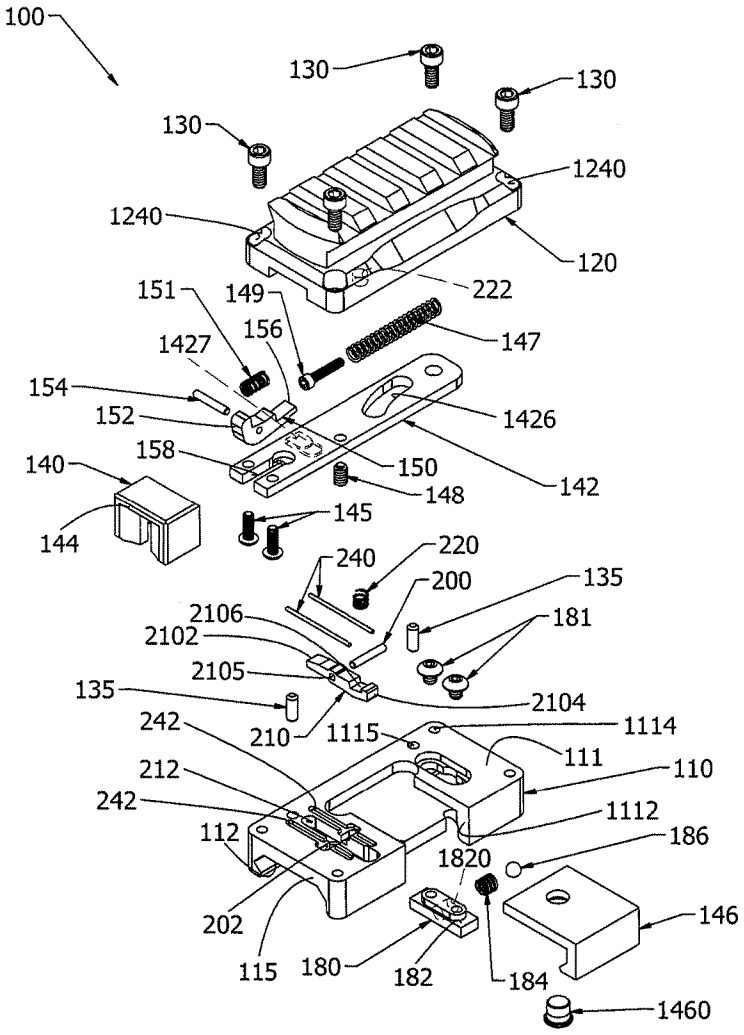
FIG. 7 is an exploded view of the device depicted in FIG. 1.
Figure 9A:
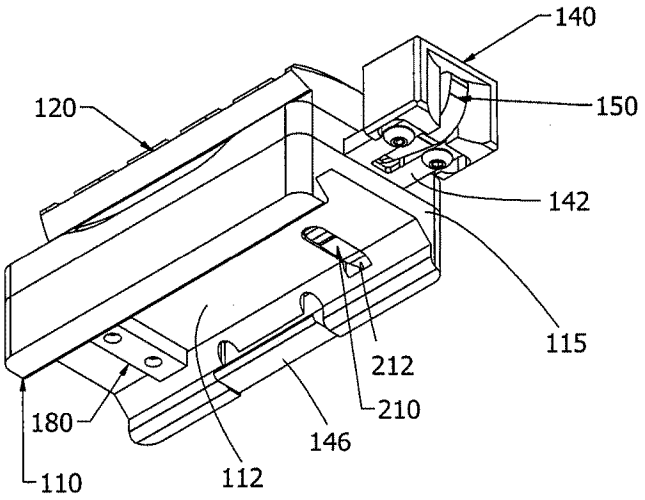
FIG. 9A is a bottom perspective view of the device depicted in FIG. 1 in a locked position.
Figure 9B:
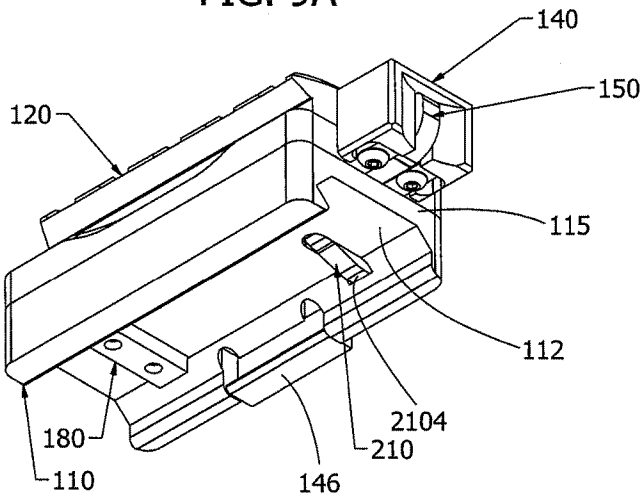
FIG. 9B is a bottom perspective view of the device depicted in FIG. 1 in an unlocked position.

As previously described, lower portion 110 is comprised of a pair of generally parallel, spaced apart fences 117, 118 that extend downwardly from said bottom surface 112 for mating engagement with rail 20 as shown in FIG. 4A. More specifically, rear fence 117 protrudes downwardly from one side of bottom surface 112 towards the front 116 of lower portion 110 and extends substantially along the length of lower portion 110. Similarly, forward fence 118 protrudes downwardly from the opposite side of bottom surface 112 towards the rear 115 of lower portion 110 and is generally parallel to rear fence 117, but that only extends partially along the length of lower portion 110, as best shown in FIGS. 7, 9A and 9B, due to the presence of one or more continuous openings 1112. Rear fence 117 further comprise a generally v-shaped groove 119 extending along a substantial portion of the length of rear fence 117 for mating engagement with rail flange 26 of rail 20. Likewise, when locking mechanism 140 is engaged, forward fence 118 and a portion of locking mechanism 140 also form a generally v-shaped groove extending along a portion of the length of said forward fence 118 for mating engagement with rail flange 26 of rail 20, as best shown in FIGS. 9A and 9B.

As best shown in FIGS. 2-4, 6 and 7, upper portion 120 is also a generally elongated member that is comprised of a top 121, an opposing bottom 122, a pair of opposing side slots 124, a rear end 125 and a front end 126. Similar to Picatinny rail 20, top 121 is also comprised of a plurality of raised, spaced apart lugs or ridges 1210, with channels 1212 located between and formed by said ridges 1210.

Bottom 122 is generally flat and preferably corresponds in shape and size with top surface 111 of lower portion 110 as shown in the Figures, with the exception of (i) an elongated longitudinal opening or channel 1220 formed therein for receipt of a portion of locking mechanism 140 and (ii) a spring channel 123 formed therein for receipt of a spring, both of which are explained more fully below. Channel 1220 preferably extends along a partial length of bottom 122 from rear 115 in the direction of front 116. Said spring channel 123 also preferably extends a partial length of bottom surface 122 to coincide with the positioning of springs, as described more fully below.

Opposing side slots 124 are similar to rail flanges 26 in rail 20, and preferably extend between rear end 125 and front end 126 and are useful for attaching accessories (such as a scope, light, bayonet, etc.) to device 100 in generally the same manner that accessories (not shown) would ordinarily be attached to rail 20. Opposing side slots 124 may further comprise a plurality of spaced apart openings 1240 extending through bottom 122. The number and placement of openings 1240 preferably correspond to the number and placement of openings 1114 in lower portion 110 for receipt of fasteners 130, which are used to fixedly attach upper portion 120 to lower portion 110, as best shown in FIGS. 1-2.

Locking mechanism 140 is preferably comprised of an elongated arm or latch 142, a handle portion 144 for engaging or dis-engaging locking mechanism 140, one or more locks 146 and one or more springs 147. Latch 142 is positioned and sized to fit and slide longitudinally within channel 1220. Latch 142 further comprises a radially shaped continuous opening 1426 therein for receipt of a cam 1460, as explained more fully below and depicted in FIG. 5. Handle portion 144 may be attached to latch 142 via fasteners 145, as shown in FIG. 7, or any other means commonly known in the art.

Figure 5:
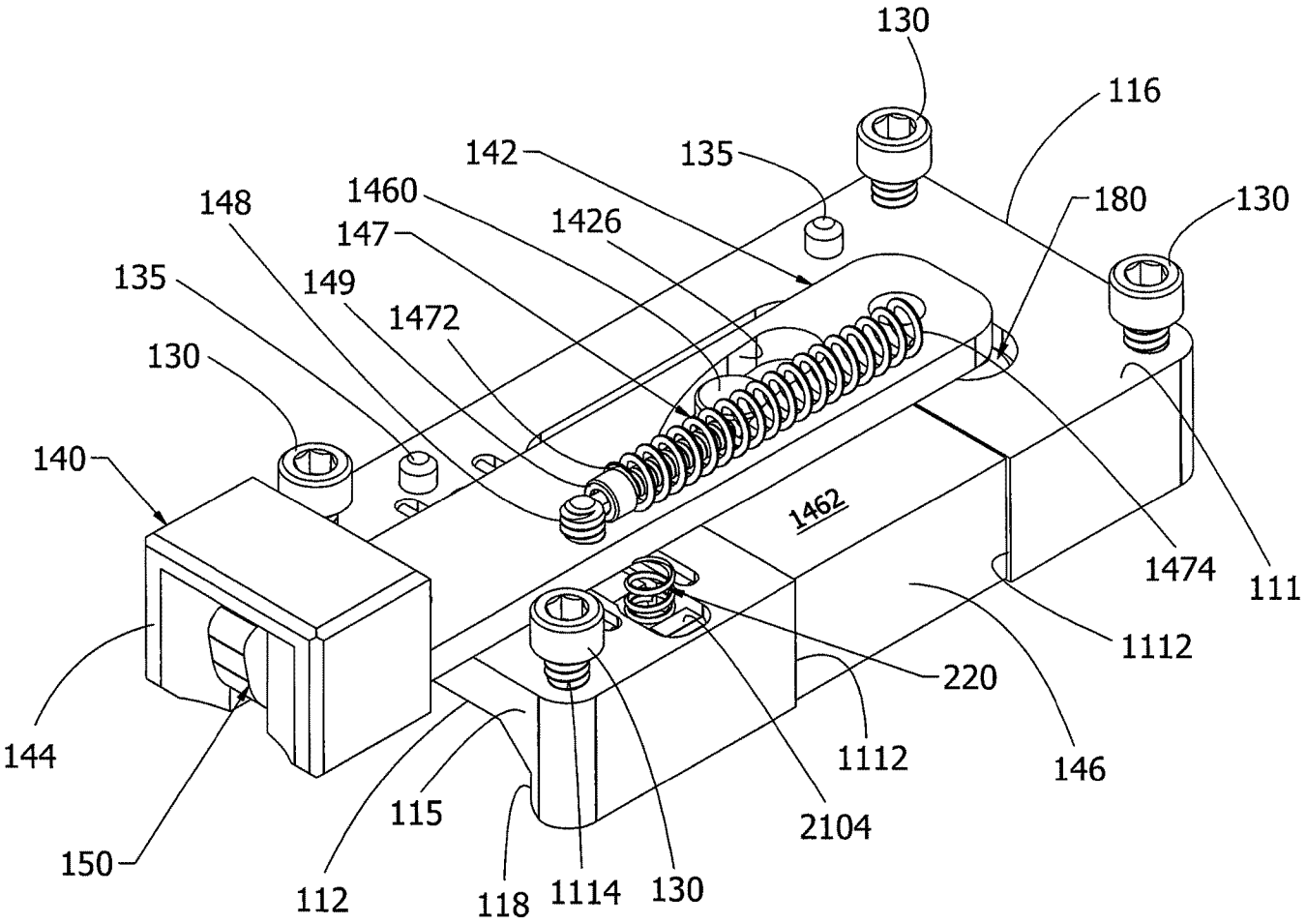
FIG. 5 is a perspective view of the lower portion and locking mechanism of the device depicted in FIG. 1.

Lock 146 is generally block-like in shape and further comprises cam 1460 that extends upwardly from a top surface 1462 of lock 146, as best shown in FIGS. 5 and 7. More specifically, cam 1460 is positioned in opening 1426 of latch 142 so that when latch 142 is repositioned longitudinally within channel 1220, cam 1460 causes lock 146 to move in and partially out of continuous opening 1112 in lower portion 110, as best shown in FIGS. 8 and 9.

A spring 147 is positioned atop of latch 142 as shown in FIG. 5 and secured to said latch via a spring post 148 and a spring pin 149. More specifically, spring 147 is comprised of a first end 1472 and a second end 1474, with said first end 1472 being fixedly attached to said spring post 148 via spring pin 149. Spring 147 is biased in the general direction of the length of device 100, as best shown in FIG. 5 and, when fully assembled, spring 147 is contained and confined within spring channel 123 of upper portion 120.

Figure 6:
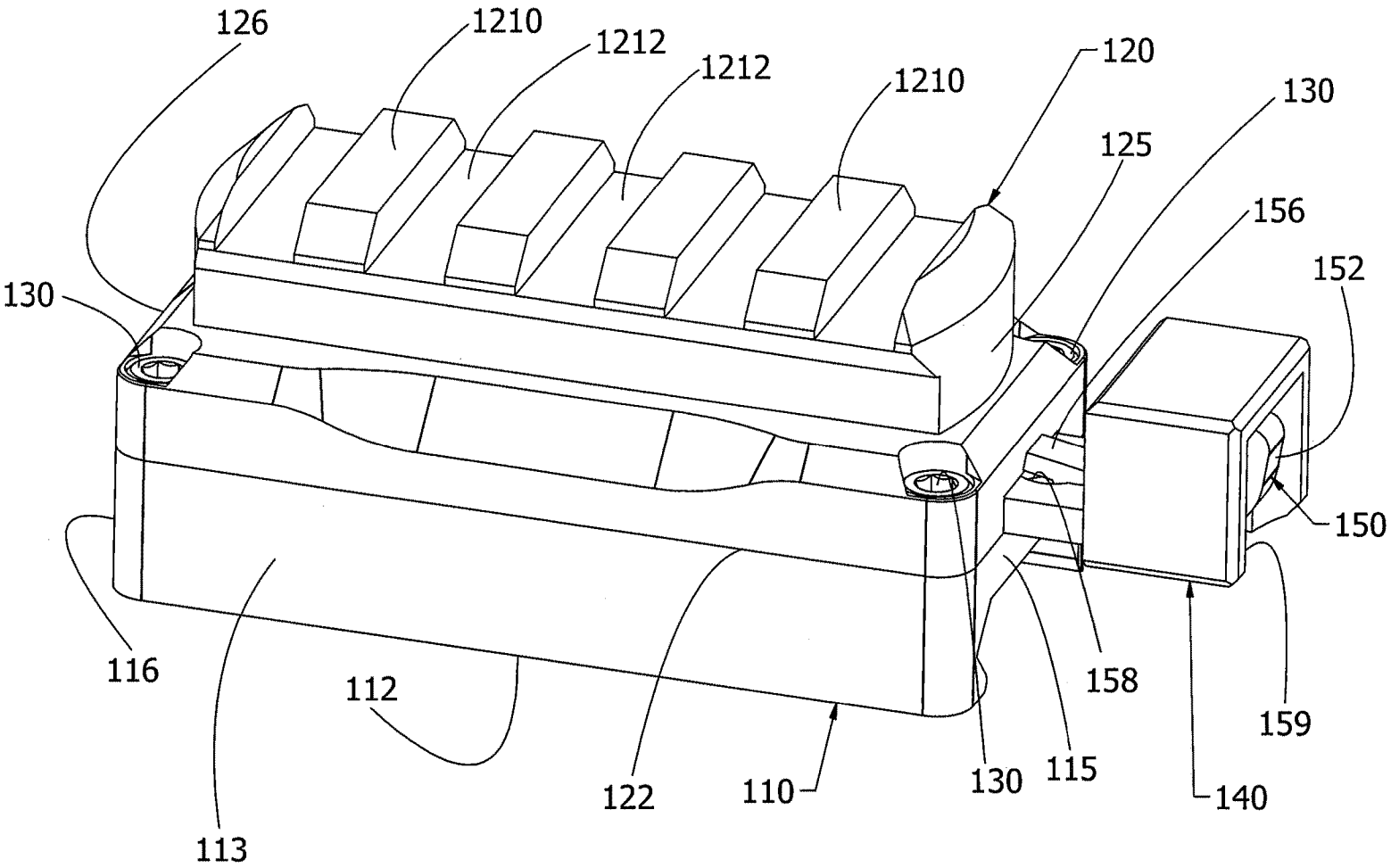
FIG. 6 is a perspective view of the device depicted in FIG. 1.

As best shown in FIGS. 5-7, locking mechanism 140 further comprises a button lock 150 for reducing the likelihood of an accidental or premature release of locking mechanism 140. More specifically, button lock 150 comprises a spring 151, a button portion 152, a pin 154 and an arm 156, wherein button portion 152 and arm 156 are preferably integrally formed and pivot about pin 154. Button lock 150 is engaged/disengaged by partially rotating button portion 152 about pin 142, as described more fully below. Button portion 152 resides in a recess 159 in handle portion 144, as best shown in FIG. 6. When in the disengaged position, arm 156 resides in a recess 158 in latch 142. When in the engaged position, arm 156 extends outwardly from recess 158 to contact rear end 125 of upper portion 120 to prevent locking mechanism 140 from accidentally or prematurely releasing, as best illustrated in FIG. 6 and described more fully below.

For purposes of further clarity, FIG. 7 is an exploded view of the device of the present invention depicted in FIG. 1. As shown in FIG. 7, device 100 further comprises an insert device 180 that may be secured to, and extend downwardly from, the bottom surface 112 of lower portion 110 with fasteners 181. Insert device 180 further comprises an insert portion 182 with an opening 1820 therein for receipt of a spring 184 and a ball 186. As more fully described below, insert device 180 is inserted into a select one of channels 24 of Picatinny rail 20 when device 100 is installed on rail 20, and biased spring 184 and ball 186 apply pressure against a select one of ridges 22 of rail 20.

As best shown in FIGS. 7 and 7-9, locking mechanism 140 further comprises an arm 210 and related components for retaining handle portion 144 in a desired position while installing device 100 onto rail 20, as more fully described below. More specifically, locking mechanism 140 is further comprised of a pin 200, arm 210, a spring 220 and a pair of spacers 240, and lower portion 110 further comprises in top surface 111 a pin channel 202 for receipt of pin 200, an arm channel 212 that preferably extends between top surface 111 and bottom surface 112 for receipt of arm 210, and one or more spacer channels 242 for receipt of spacers 240. Additionally, latch 142 further comprises an aperture 1427 therein for receipt of a portion of arm 210, as more fully described below.

As best shown in FIG. 7, arm 210 is further comprised of a first end 2102, an opposing second end 2104, an opening 2105 for receipt of pin 200 and a spring seat 2106 for receipt of spring 220, as more fully described below. More specifically, pin 200 is inserted into opening 2105 and extends from each side thereof to reside in pin channel 202 and permit arm 210 to pivot about pin 200 as arm 210 resides in arm channel 212 and extends beyond bottom surface 112 of lower portion 110. Each of spacers 240 reside in a respective spacer channel 242 and prevent pin 200 from being prematurely removed from pin channel 202. Further, spring 220 rests atop of spring seat 2106 adjacent to second end 2104 of arm 210, and first end 2102 of arm 210 resides in arm channel 212 below aperture 1427 in latch 142, as explained more fully below.

Figure 8A:
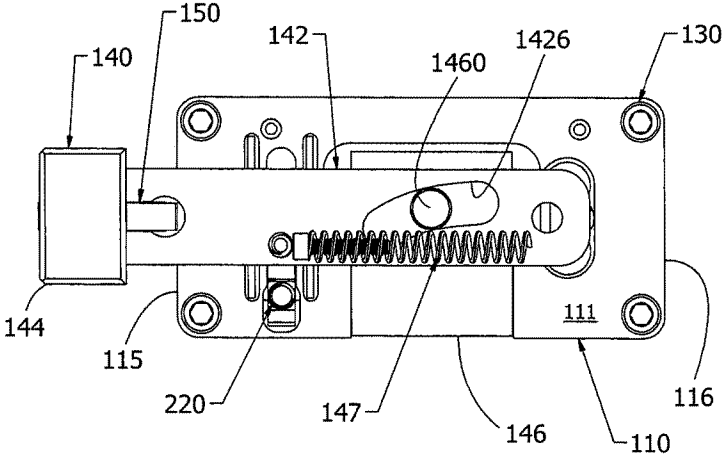
FIG. 8A is a top perspective view of the lower portion and locking mechanism of the device depicted in FIG. 1 in a locked position.
Figure 8B:
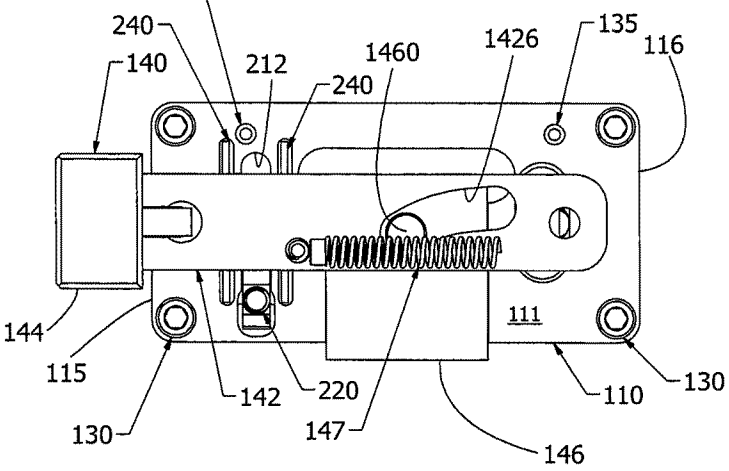
FIG. 8B is a top perspective view of the lower portion and locking mechanism of the device depicted in FIG. 1 in an unlocked position.

More specifically, when device 100 is assembled and in the locked position (meaning the handle portion 144 is at its furthest point from rear 115, as shown in FIGS. 8A and 9A), spring 220, which is positioned in compression between spring seat 2106 on arm 210 and a spring channel 222 formed within bottom 122 of upper portion 120, causes first end 2102 to pivot about pin 200 in the direction of latch 142, but is prevented from doing so until handle portion 144 is pushed in the direction of rear 115 thereby enabling aperture 1427 on latch 142 to move into position to receive first end 2102 of arm 210. Once received, handle portion 144 is prevented from moving out of the unlocked position (meaning that handle portion 144 is at its closest position to rear 115, as shown in FIGS. 8B and 9B) until such time as device 100 is placed onto rail 20, which causes the portion of second end 2104 of arm 210 to pivot in the direction of spring 220 and spring 220 to compress between spring seat 2106 and spring channel 222 in upper portion 120. As spring 220 compresses, first end 2102 of arm 210 leaves aperture 1427 and handle portion 144 returns to the locked position as shown in FIGS. 8A and 9A. In this manner, a user (not shown) is capable of installing device 100 onto rail 20 without having to both push the handle portion 144 towards device 100 and hold it there until device 100 is installed onto rail 20 at a desired location.

Having now described the general structure of a number of embodiments of device 100, its function will now be described in general terms. A user (not shown) desiring to securely mount device 100 onto rail 20 would simply push handle portion 144 in the direction of rear 115 until first end of pivoting arm 210 engages aperture 1427 in latch 142 and place device 100 (in an unlocked position—meaning the handle portion 144 is pushed in towards rear 115, as shown in FIGS. 8B and 9B) at a desired position along and on top of rail 20 so that fences 117, 118 clear rail flanges 26 and lock 146 and insert device 180 are capable of being inserted into a respective select one of said channels 24. Once device 100 is placed on rail 20, arm 210 pivots about pin 200 so that first end 2102 of arm 210 leaves aperture 1427 thereby allowing handle portion 144 (which is compressing springs 147) to release in a direction opposite of rear 115, thereby causing cam 1460 to travel clockwise within radial opening 1426 and lock 146 to securely engage Picatinny rail 20. A user may then also desire to engage button lock 150 by partially rotating button portion 152 downwardly about pin 154 so that arm 156 extends upwardly from recess 158 to contact rear end 125 of upper portion 120 to prevent locking mechanism 140 from prematurely or accidentally disengaging.

Similarly, to unlock locking mechanism 140 to reposition device 100 along rail 20 or remove device 100 from rail 20 altogether, a user (not shown) would simply (i) disengage button lock 150 by partially rotating button portion 152 upwardly about pin 154 so that arm 156 retreats into recess 158 and (ii) push in handle portion 144 in the direction of rear 115, thereby causing first end of pivoting arm 210 to engage aperture 1427 in latch 142 and spring 147 to compress and cam 1460 to travel counter-clockwise within radial opening 1426 and lock 146 to disengage from Picatinny rail 20. More specifically, as the user pushes in handle portion 144 and latch 142 moves forward along channel 1220, thereby causing spring 147 to compress and the device 100 to become capable of being installed or removed from rail 20. Once the device 100 has been installed, the compression force in spring 147 causes latch 142 to retreat to its original position.

Other variations are also within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A device configured for enabling a user to detachably mount an accessory on a Picatinny rail of a firearm device comprising:

a lower portion;

an upper portion removably attached to said lower portion;

a longitudinal channel; and a locking mechanism; wherein said locking mechanism comprises a handle portion, a latch with an aperture therein mechanically connected to a lock, a button lock and a pivoting arm for engaging said aperture in said latch, and further wherein said latch is positioned in said longitudinal channel and travels longitudinally along said device.

2. The device of claim 1 wherein said locking mechanism further comprises a spring attached to said latch.

3. The device of claim 1 wherein said locking mechanism further comprises a cam, and wherein said device further comprises an insert device comprised of an insert portion, a spring and a ball.

4. The device of claim 3 wherein a movement of the latch is translated to said lock by the cam, thereby causing said lock to move in a direction substantially perpendicular to the movement of the latch.

5. The device of claim 1 wherein said button lock further comprises a button portion, an arm and a pin and further wherein said button portion and said arm partially pivot about said pin.

6. The device of claim 1 wherein said lock is repositioned when said latch is repositioned.

7. The device of claim 1 wherein said locking mechanism further comprises a spring attached to said latch, and a cam at least partially positioned in an opening in said latch.

8. The device of claim 7 wherein each of said cam and said lock is repositioned by moving said latch.

9. The device of claim 1 wherein said lock is repositioned in a lateral direction when said latch is repositioned in a longitudinal direction.

10. The device of claim 1 wherein said lower portion is comprised of a rear fence and a forward fence.

11. The device of claim 1 wherein said lower portion is comprised of an arm channel.

12. The device of claim 11 wherein said pivoting arm pivots on a pin and is partially housed within said arm channel.

13. The device of claim 1 wherein said upper portion is comprised of a spring channel.

14. The device of claim 13 wherein said locking mechanism further comprises a spring, and further wherein said spring is positioned in said spring channel.

15. The device of claim 1 wherein said upper portion is comprised of a plurality of ridges and channels.

* * * * *